United States Patent [19]

David

[11] Patent Number: 4,932,147

[45] Date of Patent: Jun. 12, 1990

[54] METHOD OF FORMING AN APPARATUS FOR DISPLAYING DYNAMIC ART APPARATUS EMBODIMENTS

[76] Inventor: Constant V. David, 4952 Field St., San Diego, Calif. 92110

[21] Appl. No.: 780,960

[22] Filed: Sep. 27, 1985

[51] Int. Cl.[5] ..... G09F 9/00

[52] U.S. Cl. ..... 40/448; 350/351

[58] Field of Search ..... 40/448, 427, 439, 440, 40/441, 431; 350/351

[56] References Cited

U.S. PATENT DOCUMENTS

| | | | |
|---|---|---|---|
| 3,393,310 | 7/1968 | Ream | 40/441 |
| 3,802,945 | 4/1974 | James | 40/448 |
| 4,142,782 | 3/1979 | O'Brian | 40/448 |
| 4,196,976 | 4/1980 | Hoffman, III | 40/448 |

*Primary Examiner*—Kenneth J. Dorner
*Assistant Examiner*—J. R. Hakomaki

[57] ABSTRACT

Method of forming various versions of an apparatus for displaying diverse types of artistic creations in which the shapes and the colors of the art piece change continuously. The changes have both a temporal and a spatial nature, and may occur according to a set programmed schedule or at random. The art objects so formed may have a flat surface, curved surfaces and/or combinations of flat and curved surfaces. The color range extends over the whole spectrum of white light components. The art object does not emit light but reflects incident light. Under set conditions, the incident white light is either not reflected at all or a spatial combination of quasi monochromatic light rays is reflected. In some specially constructed configurations, the wave length of the reflected light is not affected by the observer's viewing angle. In other specially constructed configurations, the viewing position of the observer affects the wave length of the reflected light rays and the color which such observer perceives. In both instances, the white light reflection is performed by means of liquid crystals, some being temperature sensitive, other being orientation sensitive. In another instance, the observer is enabled to interact physically with the display so as to introduce his own input in the designs and color patterns.

8 Claims, 4 Drawing Sheets

FIG. 1
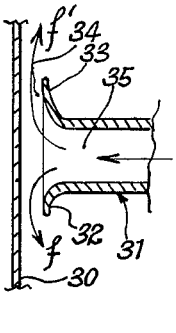
FIG. 2
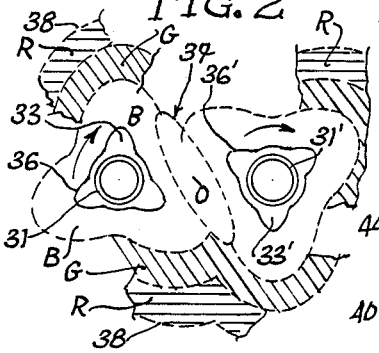
FIG. 3
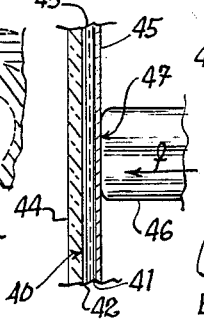
FIG. 4
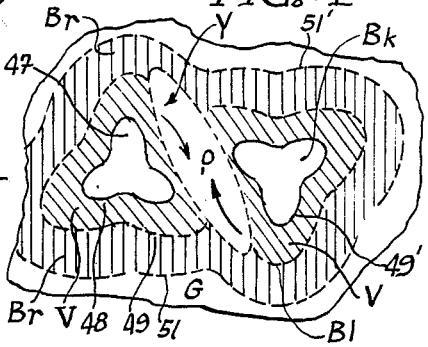
FIG. 5
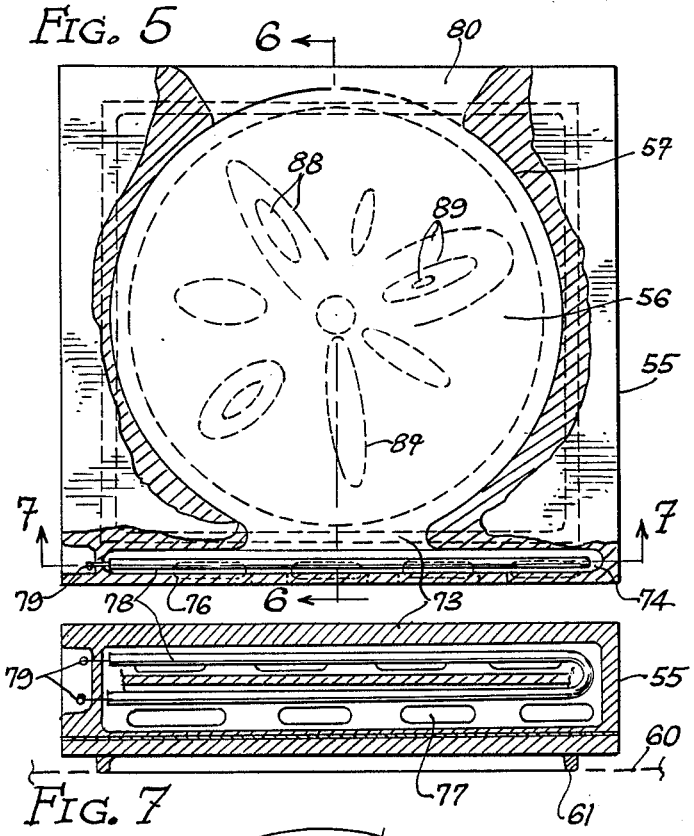
FIG. 6
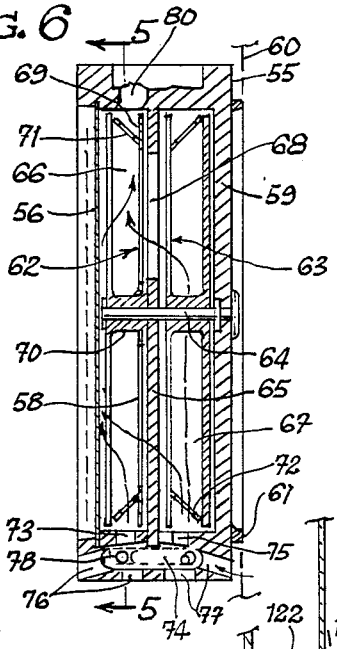
FIG. 13
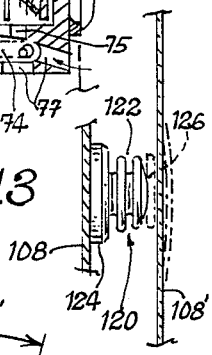
FIG. 7
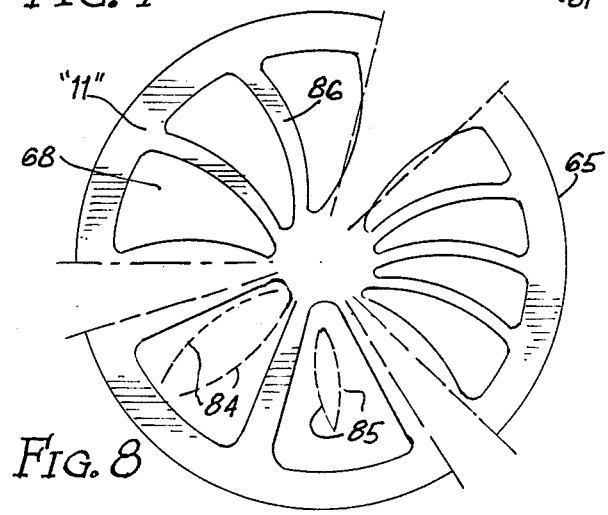
FIG. 8
FIG. 9
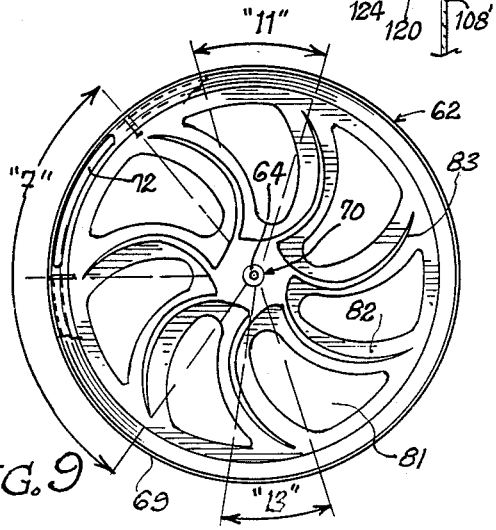

FIG. 27
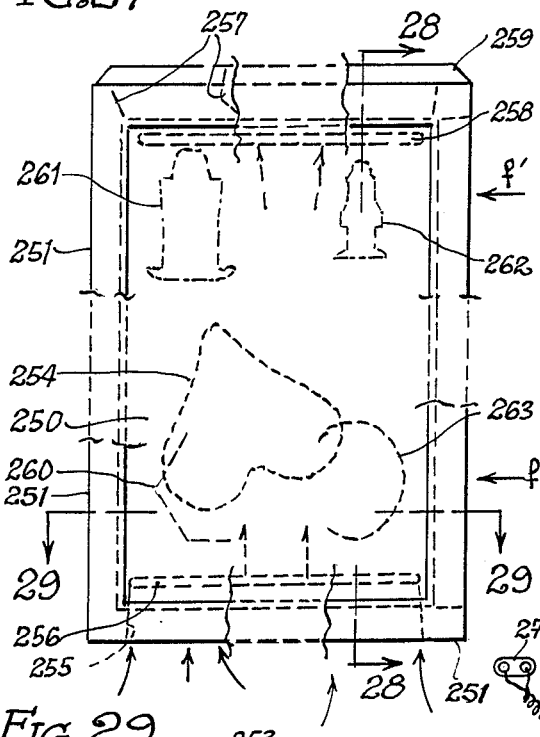
FIG. 28
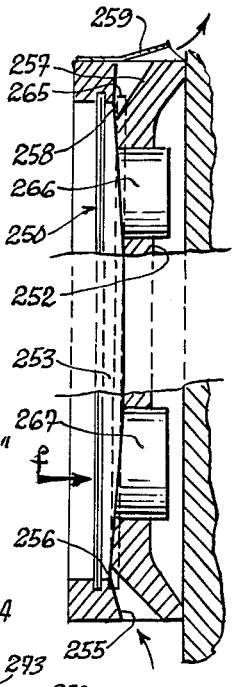
FIG. 37
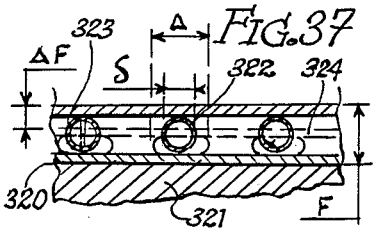
FIG. 38
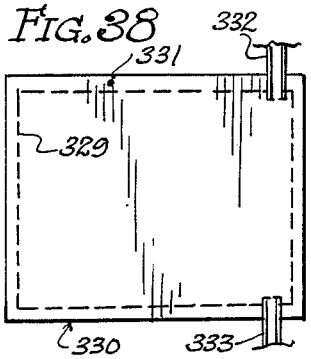
FIG. 29
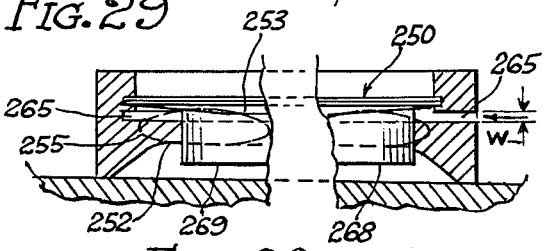
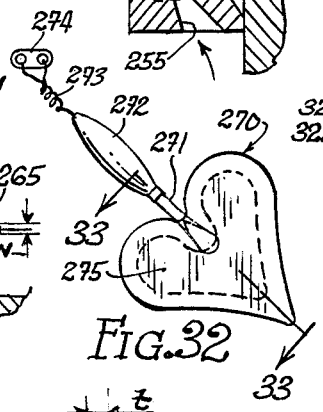
FIG. 32
FIG. 39
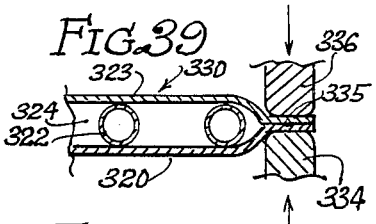
FIG. 36
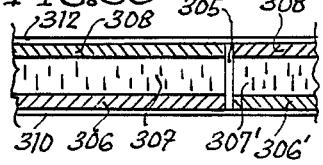
FIG. 30
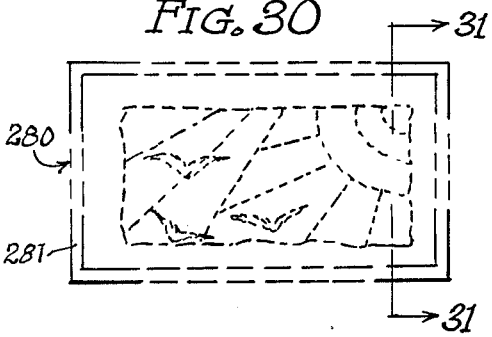
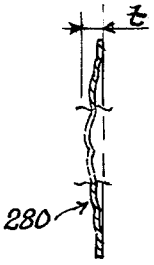
FIG. 33
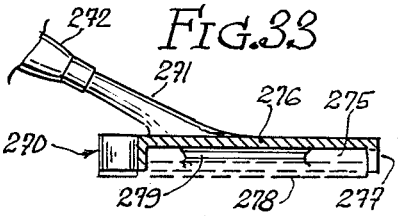
FIG. 31
FIG. 35
FIG. 34
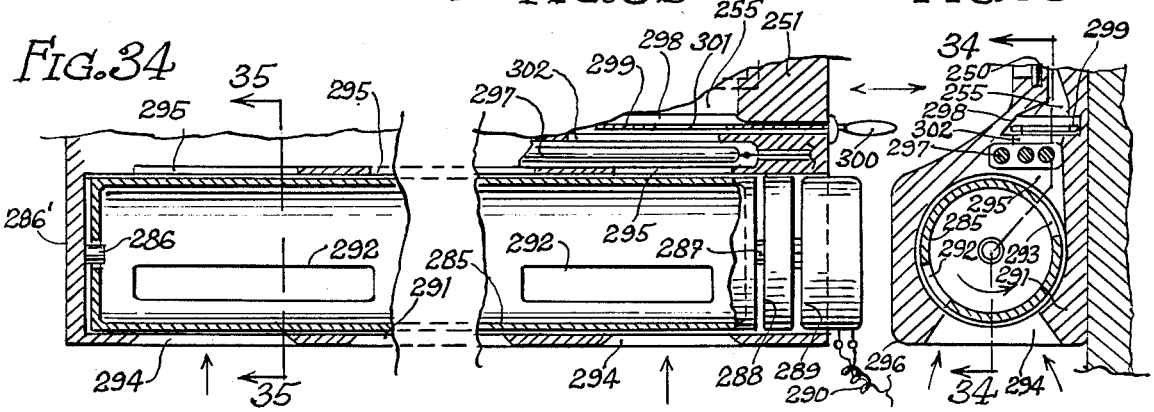

METHOD OF FORMING AN APPARATUS FOR DISPLAYING DYNAMIC ART APPARATUS EMBODIMENTS

BACKGROUND OF THE INVENTION

The present invention generally relates to art and its expression in the form of shapes, colors and combinations thereof in a manner such that both forms, shapes and/or colors thereof may change in time and in space, either at random or according to predetermined patterns and/or time sequences. The present invention is more particularly concerned with apparatus and method for causing and generating such changes, while the method is conceived and the apparatus is constructed in a manner such that the artist is offered full choice of patterns, designs, shapes and colors which he may wish to incorporate and/or combine in his (her) artistic creations.

From times immemorial,man has been fascinated by forms,still or mobile, colors and/or changing colors. Rainbows or the light transmitted by prisms or reflected from a thin oil film have been all mysteries to man for ages and are examples of the contribution from nature to such fascination. From the Cro-Magnon Man to modern man in modern times, continuous attempts have been made to either reproduce in paintings that which the eye perceives or to capture and preserve that which the eye had once perceived or dreamed of perceiving. The generic name for such attempts is ART. During the past few generations, possibly because of a new fascination that man developed for movements not created by nature processes but generated by his own non-art creations, man has strived to simulate such movement perception in his art creations, even in the three dimensional domain. However, in all cases, such movements had to have taken place in some time passed, or must result from another movement of man's own design.

Consequently, a need exists for improvements in the nature of the means put at the disposal of artists. Such improved means will offer wide new horizons and enhanced possibilities to the artist for letting his (her) imagination run wild. The end result thereof being new types of artistic creations for viewing, appreciation and enjoyment by those who are less fortunate and can only assume the passive but valuable role of observers.

SUMMARY OF THE INVENTION

It is therefore an object of the present invention to provide a method and an apparatus for use by artists to arrange combinations of forms, patterns, designs, shapes and/or colors in a manner such that the artist's expression is given a life of its own in the context of time and space.

It is another object of the present invention to provide an apparatus and a method for creating art objects such that the artist's creation changes its appearance randomly and independently of his (her) will, once created.

It is still another object of the present invention to provide a method and an apparatus for creating art objects in a manner that enables the artist to program the future expressions of his creations, and give the viewer a chance to input his.

It is still another object of the present invention to provide a method and an apparatus for creating art objects that may assume either a flat shape, curved shapes or combinations thereof, in the manner conceived and intended by the artist.

Accordingly, the present invention provides a method and an apparatus which enables artists and aspiring artists alike to express themselves by means of new ways of expression,temporally and spatially in any combination thereof, which involves the dynamic aspect of motion, not of objects but of forms and colors, and allows the viewer's physical interaction.

DESCRIPTION OF THE DRAWINGS

FIG. 1 is a schematic of a side view of a typical air vent facing a film dynamic art material.

FIG. 2 is a schematic of a frontal view of the air-vent/ film arrangement of FIG. 1 showing color patterns.

FIG. 3 is a schematic of a side view of a typical pressure applying nd of a section of another type of dynamic art film.

FIG. 4 is a schematic of a frontal view of the arrangement of pressure and film of FIG. 3 showing color patterns.

FIG. 5 is an elevation view of an art object using the construction arrangement of FIGS. 1 and 2.

FIG. 6 is a midsectional elevation view of the art object of FIG. 5 along section line 6—6 of FIG. 5.

FIG. 7 is a sectional plan view of the bottom part of the art object of FIG. 5 taken along section line 7—7 of FIG. 5. FIG. 8 is an outline elevation view of three possible shapes of a in rotatable member of FIG. 1–2 art object.

FIG. 9 is an elevation view of one internal rotatable member of the art of FIGS. 1 and 2.

FIG. 13 is an elevation side view of one type of an expansion member in the art object of FIG. 10.

FIG. 27 is a plan view of a frame and its viewing screen constructed for enabling the viewer to interact with the dynamic art display.

FIG. 28 is an elevation sectional view of the dynamic art display section line 28—28 of FIG. 27.

FIG. 29 is a sectional top view of the dynamic art display taken along line 29—29 of FIG. 27.

FIG. 30 is a partial plan view of an embossed plate for insertion in of FIG. 27.

FIG. 31 is a partial elevation sectional view of an embossed plate along section line 31—31 of FIG. 30.

FIG. 32 is a top view of the paddle utilized by the viewer for interacting with the dynamic art display presented in FIG. 27, for instance.

FIG. 33 is a partial elevation midsectional view of the paddle taken along section line 33—33 of FIG. 32.

FIG. 34 a partial plan sectional view of the manual and automatic registers which may be utilized in conjunction with the dynamic art display of FIG. 27 taken along section line 34—34 of FIG. 35.

FIG. 35 is a partial side sectional view taken along section line 35—35 of FIG. 34.

FIG. 36 is a partial magnified sectional view of a typical dynamic art film showing the juxtaposition of two adjacent sections of the film.

FIG. 37 is a diagrammatical sectional view of the dynamic art film which utilizes hollow balls for separating the two the film.

FIG. 38 is a plan view of a film constructed as shown in FIG. 37 with the filling tubes still attached before the space between the is filled with matrix fluid.

FIG. 39 a partial elevation sectional view of the seal formed by the two membranes and of the tool application needed for forming such seal.

DETAILED DESCRIPTION OF THE INVENTION

Figure 10:
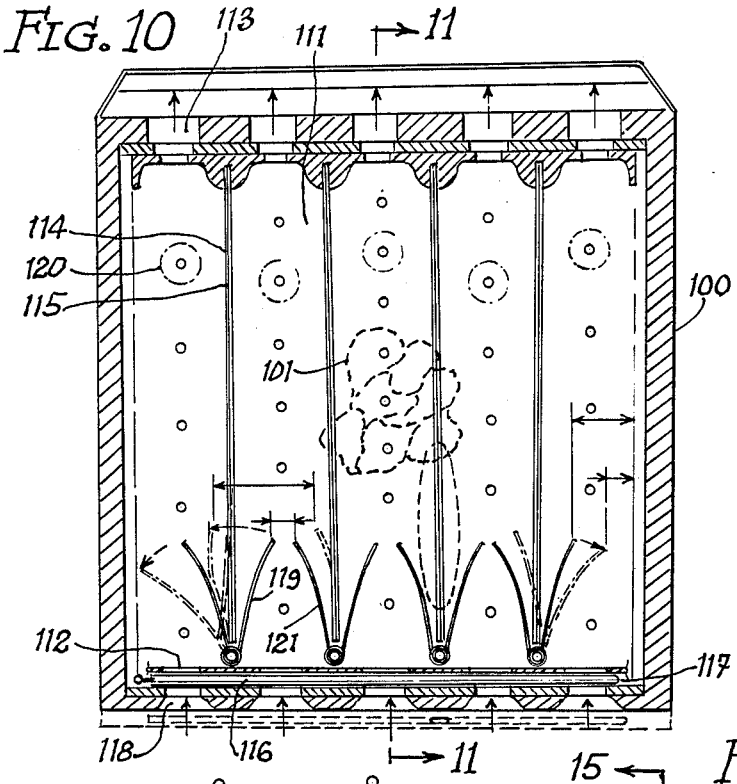
FIG. 10 is a sectional elevation view of an art object using the and film arrangement of FIGS. 3—4 taken along of FIG. 11.
Figure 11:
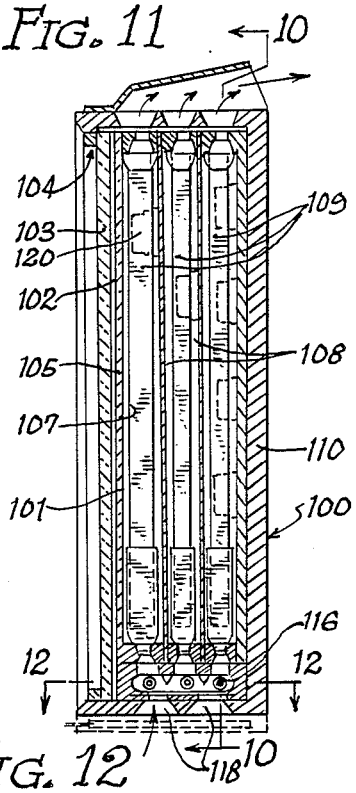
FIG. 11 is a sectional side view of the art object shown in Figure along section line 11—11 of FIG. 10.

Referring to FIGS. 1 to 4, the base embodiments of the invention are illustrated. FIGS. 1 and 2 pertain to the temperature sensitive film configuration used for constructing dynamic art objects. FIGS. 3 and 4 pertain to the pressure sensitive film configuration used for constructing dynamic art objects. Although the expression "pressure sensitive" is used, the response to applied pressure happens via the influence of viscous shear stresses that develop in the matrix material in which encapsulated liquid crystals are dispersed, the gradients of those shear stresses cause the liquid crystal microcapsules to reorient themselves. In both film configurations, the birefrigent (or double refracting) property of liquid crystals is utilized. This common and essential trait of the present invention is described first.

Birefringence is an optical phenomenon that characterizes liquid crystals. What are liquid crystals?Liquid crystals became first the object of research by an Austrian botanist, Freidrich Reinitzer, in 1888. In the early 1960's, they were finally developed for very specific applications. During the first half of the 1970's, the use of liquid crystals came to the attention of the general public, by means of their applications to consumer products. The appellation "liquid crystal" results from their behavior which is partly that of liquids and partly that of solids having a crystalline structure. The behavior of interest here is that which pertains to optics. Although many forms and compositions of liquid crystals are commercially available, the most commonly used belong to the cholesteric type. Cholesteric liquid crystals are used as an example in the following description of the behavior of liquid crystals in general and such choice is no indication of a limitation in the type of liquid crystals referred to in this disclosure and usable in the present invention. The chemical composition of such organic materials classifies them primarily as cholesteryl esters and are well known in the art. This chemistry aspect needs no further elaboration.

Liquid crystal molecules have a tendency to align themselves in parallel multilayers of "liquid crystal" structures, although the molecules in one layer do not necessarily orient themselves parallel to the molecules in an adjacent layer. When a single liquid crystal is heated from its solid crystalline phase, the material enters an intermediate state of matter called the "mesophase" and which is the "liquid crystal" phase. In such state, the compound exhibits the properties of liquids and solid crystals. It is then that the compound scatters incident white light into its monochromatic color components, as does a prism. The intensity of the colored light rays is therefore dependent on the intensity of the incident white light.

The then perceived color of the compound changes as its temperature increases: from reds, through yellows and greens into blues and violets. The colors are expressed in the plural form, as none is distinctly monochromatic, each color blending somewhat with the next. During the cooling phase, the direction of the color changes is reversed (violet-red). Each specific organic chemical experiences its phase change within a fixed narrow temperature range.Different such chemicals change phase at different temperatures. Mixing various amounts of specific chemicals results in formulations that exhibit these color changing characteristics over a wide range of temperatures, each formulation being characterized by the temperature range which corresponds to the full extent of color change and the temperatures at which such range starts and ends. A common application is that which enters in the construction of the now well known and widely used "chemical" thermometers.

As an example, the overall range of temperatures of commercial products extends from $-20\pm$C. to $+250\pm$C. For a specific compound, the temperature range corresponding to a full spectrum color change can be as small as $1\pm$C., and can be made as broad as $50\pm$C. The latitude offered by such compounds is extremely varied and very flexible. Practically, the liquid crystals are encapsulated in tiny capsules of a 20-30 micron size which can respond to temperature changes of interest within typically 0.2 seconds. Both the encapsulated material and the capsules already embedded in a holding matrix are commercially available.Although capsules dispersed in a water slurry for instance can be used like paint, to cover or coat an appropriately prepared thin structural web, the present disclosure describes and discusses the use of already embedded capsules. The capsule-supporting structure referred to as dynamic art film is the material entering directly into the construction of the embodiments of the present invention presented herein. It is to be understood that the examplary selection of such an approach does not limit the use of liquid crystals to that of the capsule embedded form and that the following is intended to cover all preparation features which enter into the construction of a dynamic art film incorporating temperature sensitive liquid crystals.

The dynamic art film illustrated in FIGS. 3 and 4 is constructed in a different manner. The encapsulated liquid crystals are dispersed in a liquid matrix of suitable viscosity. The matrix is contained between two flexible layers of suitable plastic materials. The liquid crystals are in their mesophase state in the range of temperatures to which the art object is exposed. At room temperature, they appear to exhibit a specific and well-defined color, when viewed from a given angle, e.g. normally to the film surface. However, the color perceived changes as the viewer alters his viewing angle.The color thus perceived depends on a new parameter:the viewing angle of the crystals. Such change of viewing angle can also be achieved, the observer remaining still and viewing the film at a constant angle,when the orientation of the liquid crystals themselves with respect to the observer is altered. This can simply be done by applying different degrees of pressure on areas of the film close enough to one another to cause the matrix fluid to flow between the film two plastic layers. A local-pressure sensitive film results. The changes of color perceived are no indication of pressure per se, but of pressure gradients over the film surface. For ease of expression the "pressure sensitive" appellation is used in the following, but it is understood that pressure-gradient sensitive is meant.

Although,in principle, the temperature-sensitive dynamic art film responds equally to ambient temperature variations or artificially induced temperature changes, the naturally ocurring variations of ambient temperatures are usually slow and small, especially in air conditioned environments such as in museums. Also, an ambient temperature variation affects the whole surface of the film. Slowing the rates of cooling or warming of localized areas of the film is easy enough by installing heat sinks locally behind the film, which will create transient temperature gradients across the film surface, but very slowly. The pressure-sensitive dynamic art film has an almost instantaneous response, as fast as the pressure gradients are generated.In an art object, practically, such pressure gradients are created by quickly applying pressure locally on one side of the film surface and reacting this pressure by means of a transparent rigid support located on and supporting the other side of the film.

With the background provided above regarding both types of dynamic art film, the sketches of FIGS. 1 to 4 can be more easily described. As mentioned earlier,-natural temperature changes are too slow to consider practically, although such an approach is discussed in the following section. In FIG. 1, film 30 is held at its periphery by a frame (not shown), its left face being the surface viewed by an observer, receiving the incident white light and "reflecting" the "colored" light, which is the only light that the observer perceives.In order to hide the frame back wall and/or the various mechanisms located behind the film (right side), the plastic material layer located on the right hand side of the section of the film is opaque, can be black, white and/or mirror-like. Assuming it is black, a black background is thus provided by the film, providing the contrast needed to enhance the brightness of the film colors. The film layer facing the observer must be transparent to let both types of light pass through.

A duct 31 is positioned behind the film so that flared out flange 32 and lobe 33 leave a passage 34 open for air flow 35 to escape tangentially to the film. FIG. 2 shows how an identical conjugate duct 31' with lobes 33' can be located in such a way as to cause the air flows escaping both ducts to interfere and generate various patterns of air flows parallel, locally, to the film back surface. Several combinations of a number of construction parameters can be arranged, either randomly or in a programmed fashion. They are listed below, with the intended result or the direct action indicated between parenthesis:

1. the width of the air gap (moving the duct in and out);
2. the temperature of the air (with respect to ambient);
3. the velocity of the air flow (increased heat transfer rates);
4. the distance between adjacent ducts (interference patterns);
5. the relative angular duct position (interference patterns);
6. the temperature characteristics of the film (spatially); and
7. the speed at which the relative angular duct position is caused to vary (interference pattern changes).

This list is not limitative but long enough to demonstrate that the numbers of such combinations is large indeed,since more than two permutations are possible at any one time.Assuming that steady state conditions are established at a given time (nothing has changed for long enough), and that a large number of ducts are located around ducts 31 and 31'in a symmetrical array fashion, that ducts 31 and 3' are located at the same distance of the film and that both ducts channel warm air at the same temperature, different points of film 30 reach and remain at well determined temperatures higher than ambient, the highest temperatures being at or close to the flange and to lobe contour 36 or 36'.The film temperatures decrease as the distance from contours 36 and 36' increases. Contours joining points at equal temperature, higher than ambient, are shown in concentric phantom lines up to an area where two contours pertaining to two adjacent duct profiles interfere. Such spatial interference may create a zone 37 on the film in which temperatures may even be higher.

Assuming that the film temperature at contour 36 corresponds to the film color change range higher limit (violet) and that at contour 38 the film temperature corresponds to the lower limit of the color change range (red), the color patterns viewed by an observer will be those which are partially illustrated and shaded. They are identified by the letters R (red), G (green) and B (blue). The inside of contour 37 is black, if the film temperature at point 0 is higher than that of contour 36.As earlier mentioned, this represents a steady state condition. But,if any one of the parameters previously listed (or combinations thereof) vary slowly with time, the shapes of the color contours will also vary. If the heat transfer rate from the warm air to the film is too slow and the parameter varies too fast, the film temperature will not vary enough. The color changes will not cover the whole range of color variation. If the parameter variation does not happen too fast, the color changes follow the parameter variation temporally and spatially. For instance, if ducts 31 and 31' are caused to rotate slowly as indicated by the arrows, but at different rates, the color patterns will be slowly altered in shape and in the spatial distribution of colors.

In FIGS. 3 and 4, pressure sensitive film 40 consisting of plastic layers 41 and 42 containing layer 43 of the viscous matrix in which the encapsulated liquid crystals are dispersed, is supported on the left by rigid transparent wall 44. Layer 41 adheres to non-stretchable flexible sheet 45. The assembly of wall 44, sheet 45 and film 41-42-43 is supported vertically and laterally by a frame (not shown). A shaft 46 butts against sheet 45 along contact area 47. Pressure on area 47 can be gently applied by pushing shaft 46 in the direction of arrow f. Figure 4 illustrates what an observer viewing point 0 of transparent wall 44 in a direction perpendicular to the film surface sees when shaft end 47 compresses the film within the boundary 48 of area 47. A front of color changing rapidly moves from contour 48 outwardly. Assuming that the surface of the film was all green before the shaft contacted sheet 45, the area inside contour 48 turns black if enough pressure is applied to move most of the matrix-fluid/ liquid-crystal mixture from under the shaft end. Assuming that shaft 46 stops and remains still, within a second or two, the mixture flow ceases and steady state conditions are reached. The color patterns are those represented by phantom line contours 49, 49', 51 and 51' Five basic color zones black (Bk), violet/blue (V), blue (Bl), brown (Br) and green (G) are created. Only four distinctive color zones are shown in FIG. 4, for the sake of simplicity. The zone between the two shaft ends may take a yellowish hue (Y). As time elapses, if film and shafts are left undisturbed, the color patterns will very slowly change, as the matrix mixture slowly creeps around area 47. However, steady condition situations are never left undisturbed very long.

Several factors may come into play, singularly or in combination. Most of such factors are listed below. The results and/or the direct action taken are indicated between parenthesis:

1. other shafts are also used (interference patterns);
2. all shafts move synchronously in and out (pattern symmetry);
3. the in and out motions of the shafts are not synchronized;
4. the shafts rotate at the same speed (symmetry of motion);
5. the shafts rotate at different speeds;
6. the pressure applied by the shafts varies from shaft to shaft;
7. the duration of the compression period is variable; and
8. the axis orientation of the shaft is not fixed.

From the above description of the sequence of events resulting from the action of one single shaft, one can visualize the end effects of any of the actions listed above. The spatial relationship between the positions of various sources of pressure disturbances can also be caused to vary. The end results are an assemblage of continuously changing patterns of shapes and colors. Because the response time of such film is fast, such pattern changes may be caused to take place at rates much higher than those obtainable with temperature sensitive films, although the precision in color definition and steadfastness is less certain.

Description of Art Object Constructions

The sketches of FIGS. 1 to 4 were used to explain and describe the phenomenology of dynamic art, in terms of production of colors, creation of color patterns and shapes, and their temporal relationships. This fundamental aspect of dynamic art based on colors is more of a technological than of an artistic nature. However, its understanding is of primordial importance. So is that of the following. For instance, a painter cannot instill meaning and life to his creativity unless he has paint and brushes to paint with, canvas to paint on and an idea of what his painting will represent (that part has become more and more questionable in modern times). To pursue the analogy a step further, the "paint" and the "brushes" of dynamic art have been described. The "canvas" and the means for holding the "canvas" have not yet. That aspect of the present invention is also necessarily technological in nature, but essential.

The manner by which the dynamic art artist can both apply "paint" on the "canvas" and give shapes to forms which are intended later to acquire lives of their own,is to define the subject of the art object, the shapes and forms it will experience, its colors and what the assemblage will express. This is achieved by juxtaposing selectively shaped "puzzle pieces" of chosen film, defined by its nature (temperature or pressure sensitive) and its response (temperature range and level). Both types of film can be cut and trimmed to shape and their edges sealed. Either face or both can be coated with a pressure sensitive adhesive (such films are available commercially). The "puzzle" pieces can be assembled on a backup sheet (45 of FIG. 3). The assembled "canvas" film can be trimmed and mounted on a frame. At this juncture, a distinction must be made between the two types of dynamic art film.

The pressure sensitive film requires external means for applying pressure. The temperature sensitive film can perform its function equally well with or without the adjunct of temperature varying mechanisms. Ambient temperatures always vary sufficiently to provide the means for affecting the film response. In either instance of film nature, another dimension can be added to the dynamic art display: that of the viewer's participation. It has already been mentioned that the position of the viewer affects the colors perceived in the case of the pressure sensitive film. Another kind of viewer's participation is now meant. If viewer interaction with the art object is anticipated and desired, provisions must be made in the art object construction both to facilitate the interaction and to protect the art object. It is obvious that the nature of the film imposes different construction limitations and/or modes of interaction. Each type of dynamic art film is examined separately. Pressure sensitive films need a rigid surface against which pressure can be applied. In FIG. 3, the rigid surface is provided by transparent wall 44. The medium through which pressure is applied is flexible sheet 45. In such a type of construction,the viewer cannot interact with the film. However, if wall 44 is rendered flexible enough and sheet 45 is made rigid enough, the viewer can push against wall 44 and superimpose his own color patterns on whatever display is already there. The type and mode of operation of the mechanism, and of its actuation, that plays the role of shaft 46 must be constructed to be compatible with a less rigid wall 44 and a more rigid sheet 45. This means that only less sharp and contrasting color patterns are possible in such case.

Unless the viewer is meant to interact with a temperature sensitive film, very little or no physical protection of the viewed face of the film is required.If interaction is intended, the viewed face can easily be protected by a transparent film such as MYLAR (Trademark) film onto which the "puzzle" pieces of the dynamic art film are then made to adhere. If the protection film is thin enough, its added mass will not noticeably affect the warming (or cooling) rate of the dynamic art film. The temporal color response to temperature variations will remain the same. In this instance, the addition of the protection film does not interfere with the warming mechanism type and/or mode of operation. Full compatibility is possible in this case. Examples of means for viewer interaction are discussed later on in this section.

As earlier mentioned, art objects utilizing temperature sensitive film pieces,do not require built-in heat sources. Ambient temperatures can easily be caused to vary locally within a small confined space by three-four degrees centigrade. Because a full spectrum of colors can be made to appear within a 1±C range, total variations of 3±C offer enough possibilities to satisfy the requirements of most artistic creations to be superimposed on the same art object. The natures and motives of such creations are totally different from those which are more suitable for displays that include internal warming of portions of the dynamic art film.

Some Typical Examples of Art Object Embodiments

Using the art object construction guidelines described above, some basic embodiments of the present invention are presented in FIGS. 5 to 35. Some embodiments are constructed to utilize one of the two types of dynamic art film only, whereas some are configured to make use of both types. In all instances, heat is used for causing the film behavioral responses, as being the most direct medium with the highest degree of adaptability to both film utilization, either separately or in combination.

In FIGS. 5–9, frame 55 supports temperature-sensitive film assembly 56, held at its periphery 57, which may consist of one large single circular piece or of an assemblage of many puzzle-like individual film pieces arranged to form patterns designed to interact appropriately with the temperature varying system 58. System 58 is housed within frame 55 between film 56 and back wall 59 which is isolated from building wall 60 onto which the art object is displayed by guard ridge 61. As an example of a simple mechanism, system 58 is shown consisting of two balanced free-rotating wheels 62 and 63 revolving around common axle 64 supported by back wall 59 and open partition wall 65.Partition wall 65 separates the frame 55 internal volume into two chambers 66 and 67, and has openings such as 68 which permit warm air to flow as indicated by the arrows. Each revolving wheel is composed of one flange 69 connected to hub 70 and conically shaped web 71 equipped with openings 72 through which warm air can flow freely.

Both chambers 66 and 67 are vented at the bottom through openings 73 and 75 connected to heating space 74 open to the outside through vents 76 and 77. Space 74 houses a heating element 78 to which electrical power is brought by means of prongs 79. Such heating elements of a few watts in power are commercially available, maintain a maximum surface temperature low enough to prevent skin burns, and generate enough heat to warm up a small column of slowly ambient air from ten to twenty degrees centigrade. The warm air ascends through chambers 66 and 67. Chamber 67 is closed at the top, but chamber 66 is open by means of vent 80, so that all of the warm air entering chamber 67 is forced to flow through chamber 66 as well and to come in contact with the back surface of film 56. These combined warm air flows cause the spatial temperatures of the film to rise erratically because of a programmed air turbulence generated by the wheel rotations. The flanges of both wheels have shaped openings such as 81 of FIG. 9. Each curved radial arm 82 is equipped with a curved vane such as 83. Because the wheels are mounted back to back symmetrically with respect to partition 65, the curvatures of the vanes of the wheels, once assembled, are reversed. The vanes interact with the ascending warm air flow and, because of their reversed curvatures, rotate in inverse direction. Both wheels will rotate in the same direction if the their vane curvatures are inverted with respect to one another. In the first case, the air flow patterns change rapidly, whereas they vary much more slowly in the second case. The openings 68 in partition wall 65 allow the warm air to flow across both wheel flanges. The number and shapes of these openings affects the degree of turbulence of the flowing air and the heat transfer mode between the warm air and the film, therefore influences the temperature distribution on the film and the resulting color patterns. FIG. 8 three typical arrangements of openings 68 in which the nu ted by a number such as "11") and/or shapes of openings 68 are different, as typical examples. The number of openings "11" indicated in FIG. 8 corresponds to numbers "11", "7" or "13" indicated in FIG. 9. 7, 11 and 13 are all prime numbers and are selected as examples of a way to prevent "resonance" phenomena from developing. The selection of these numbers also affects the formation of the color patterns and changes thereof. Phantom line contours 84 and 85 indicate typical profiles of passages offered to the warm air when some of the typical openings of the counter-rotating wheels happen to be in line with a partition wall opening. The sizes of such passages vary between 0 and a maximum value determined by the relative width of arms 82 and 86.

As the wheels rotate and as the warm air flows by the back side of the dynamic art film, designs and shapes appear on the exposed face of the film. Such designs are illustrated by the family of phantom lines such as 87, 88 and 89. Because colors cannot be easily represented, concentric contours are used for showing the outlines of the contours where a basic color changes to another. Contour 87 corresponds to the display of only one color, contours 88 to two colors and contours 89 to three colors, with the background color remaining uniformly black if a one-piece film with black background is used. If film assembly 56 consists of an assemblage of a multitude of film pieces with various temperature responses, a mosaic of colors and shapes results. The overall picture may then seem to rotate slowly if so arranged. The semblance of picture rotation can be obtained by adjusting the wheel rotations, the number of openings, the openings in the partition wall,the flow rate of the ascending warm air (by means of a register located at the top of the frame and varying the size of opening 80) and the film configuration. Specific combinations of such variables will produce the illusion of rotation in either direction when appropriately selected. The degree of flexibility inherent to such art object design and construction as provided by the described embodiment is certainly high enough to offer the possibility of such selection.

The art object construction depicted in FIGS. 10 to 16 is based on the utilization of a pressure-sensitive film. A frame 100 supports film assemblage 101 around its periphery. The front surface of the film 102 is backed by transparent rigid wall 103 connected to the frame and held in place by locking ring 104. Film 101 consists of the three typical layers earlier described 105 and 107, with the liquid crystals and matrix mixture located in between. Layer 107 also plays the role of sheet 45 of FIG. 3, for simplification purpose. A plurality of flexible partition walls 108 help define a plurality of chambers 109 stacked up between the film and frame 100 rigid back wall 110. Each chamber is divided vertically into a plurality of sections such as 111.Each section receives warm air through opening 112 and which escapes through opening 113.A plurality of fixed rigid walls such as 114 separate the sections. These walls have openings such as 115 so that warm air can flow between sections, if desired.

A heating element 116 housed in space 117 warms up the ambient air that enters through openings such as 118. The warmed air then enters the fifteen (three chamber layers of five sections each) sections for its upward ascension. As the warm air enters a section at its bottom, it first encounters bimetallic elements such as 119 and 121, supported by fixed pivots and constructed to bend when heated as shown by the arrows, in order to assume the shapes shown in phantom lines. The gap between the ends of two contiguous elements in a section adjusts the air flow into that section. The larger the gap, the larger the air flow rate and the higher the heat transfer rate between the air and the bimetallic element. The element heats up and as it does, the bimetallic shape curves and the gap starts closing. The response time of the elements are such that they do not maintain a fixed deformed intermediate shape, but complete full bending cycles.

As the gap-adjusted warm air flow ascends along one section, it passes by a plurality of temperature-responsive elements such as 120. These elements are of two types in this embodiment, one expands slowly and the other also expands slowly but is equipped with a quick snapping flat spring, also temperature sensitive. Both element constructions are presented in FIGS. 13 and 14. The portion of the element common to both constructions is described only once. FIG. 13 illustrates such common portion. Expandable bellows 122 contains a liquid that vaporizes around the average of the temperatures of the warm air passing by. Base 124 is associated with wall 108 and free rounded end 126 pushes on wall 108' or retracts from it, depending upon the element temperature. If it is warm enough, wall 108' deforms as shown by the phantom lines.If not, wall 108' remains in place and flat. Such elements are positioned throughout sections 111 of chambers 109,either on a common axis, or scattered around at random. Each arrangement produces different effects discussed in the next section.

Figure 14:
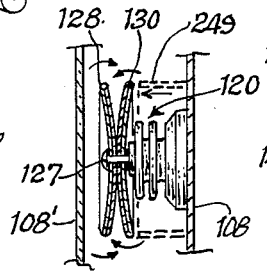
FIG. 14 an elevation side view of another type of expansion member the art object of FIG. 10.

FIG. 14 shows another version of elements 120,in which the rounded end 126 of FIG. 13 is replaced by a springy bimetallic disk 128 that snaps back and forth from position 128 to position 130 (shown in phantom lines) and which is held in place by stem 127. A small spring may be, located between the end of the bellows and disk 128 to provide displacement leeway.Both shapes assumable by disk 128 are unstable and the phenomenon is explained by the diagram of FIG. 25 which is discussed in detail later on in this section. The arrows indicate the various types of motion followed by the parts of interest of the element. The mounting and positioning of these elements are effected as described above in the case of the first element type. The second type of elements provides the quick response action which, when transmitted to film assembly 101, results in rapid changes of forms and colors.

Figure 15:
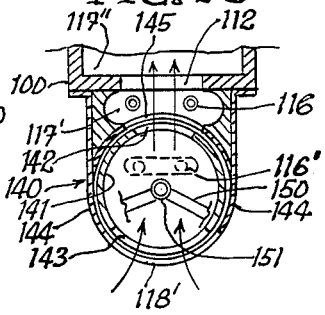
FIG. 15 is a partial sectional view of a rotatable air inlet register taken along section line 15—15 of FIG. 12.

The purpose of causing erratic flow rates of the warm air is to create temperature variations within each chamber section of enough magnitude to generate continuously different pressure points or areas on the backing sheet of the film assembly. Steady state conditions or even the possibility of it must be avoided. To prevent such eventuality, however unlikely, from ocurring, an additional programmed registering action may be provided at the bottom of the art object frame. The details of such register system are presented in FIGS. 15 and 16. Referring to FIG. 15, programmed register system 140 may incorporate one or two heating elements 116 and 116'. In either case, the system cooperates with openings 112 previously mentioned. It consists of a drum 141 provided with a plurality of openings 142 and 143 for registering with openings 118' and 145 cut in the wall 144 of the cylindrical envelope of system 140. The ambient air is permitted to flow through openings 118', 143, 142 and 145 (when positioned in series, as is the case depicted in FIG. 15) and to enter its respective section through opening 112. A rotation of a quarter of a turn of drum 141 automatically closes such passage. A partitioning wall separates each volume 117' located below its respective set of sections. Space 117'' vents into chambers 109 through openings 112, not shown in Figure 15, but as is shown in FIG. 10.

Figure 17:
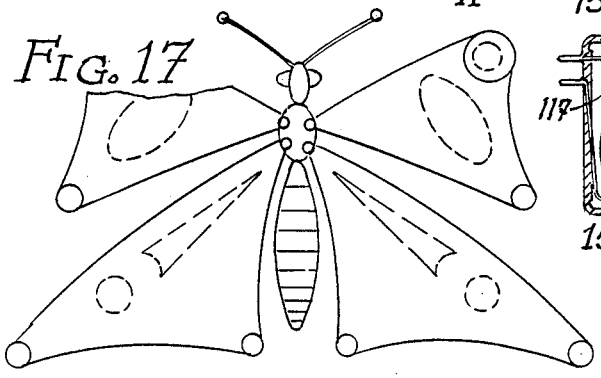
FIG. 17 is an illustration of a typical butterfly motive especially suitable for use with the film of FIGS. 1–2.
Figure 12:
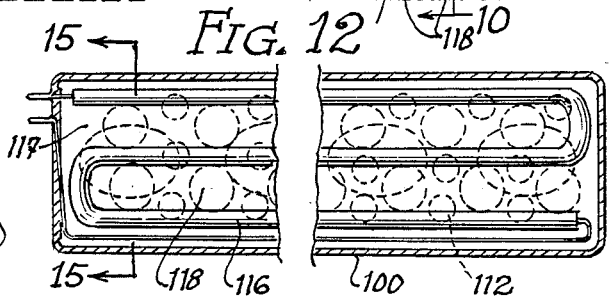
FIG. 12 is a plan sectional view of the bottom part of the art object illustrated in FIG. 10 and taken along section line 12—12 of FIG. 11.
Figure 18:
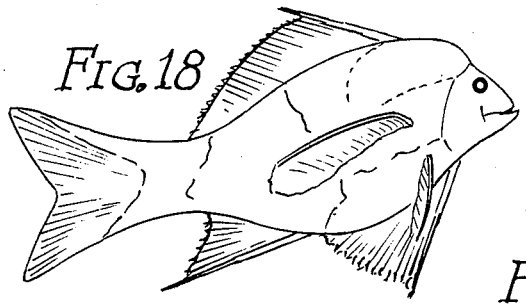
FIG. 18 is another illustration of a fish motive for use in connection the film of FIGS. 1 and 2.
Figure 16:
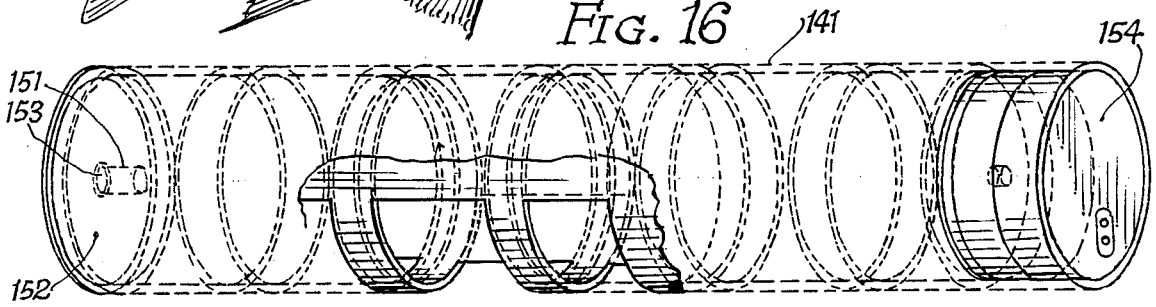
FIG. 16 perspective schematical view of the rotatable air inlet system.

Drum 141 is supported by arms 150 associated with the external structure of system 140 and holding shaft 151 on which end wall 152 of drum 141 freely rotates by means of round hole 153. At the other end, drum 141 is supported and rotatably driven by electric motor 154 which is solidly mounted on system 140 structure. If a heating element 116' is located inside the drum, the free end support of drum 141 is achieved by means of rollers supporting the external bottom surface of drum 141 cylindrical wall. The perspective view of FIG. 16 illustrates how a pair of conjugate openings 142 and 143 are positioned with respect to an adjacent pair of conjugate openings 142' and 143' This indicates how the air is either stopped or allowed to flow into a set of chamber 109 sections alternatively, as motor 154 drives drum 141 around its rotation axis. The rotation of drum 141 is very slow and motor 154 causes drum 141 to revolve as the motor of an electric clock drives the hands thereof,-possibly a fraction of a revolution per minute no bimetallic strips are then needed. FIGS. 17 and 18 show two typical motives of possible artistic illustrations which the artist may want to compose with pieces of dynamic art film for either art object construction. The sizes and shapes of each component of the motive must be tailored to correspond to sizes and shapes that are compatible with the overall size of the motive, and also with the shapes, sizes and patterns that the color activating mechanisms will most likely generate, as time passes. The ultimate success being that of succeeding in creating the illusion of movement by the motives. FIGS. 19 to 22 present an art object which incorporates the use of both types of film. The temperature sensitive film forms a curved surface and the flat pressure sensitive film is arranged to exhibit four small displays, one located at each corner of the art object frame 160. The temperature variations of the heating air are also generated by means of a heating element 162 located in the bottom part of the frame. The ascending warm air heats bi-stable bimetallic snap springs which actuate register shutters located at the entrances of spaces in which temperature sensitive mechanisms are located. These arrangements are similar to those described previously and are not shown in FIGS. 19 or 20. When warm air flows by, the snap spring closes the register, the snap spring cools down, which causes the register to open.

The internal spaces of volumes such as 164 and 166 receive such intermittent flows of warm air. They each contain a temperature-responsive element such as 120 of FIG. 13, but having its free end equipped with flat shaped surfaces such as 163, 165, 167 and 169. When these surfaces apply pressure on the pressure sensitive films, the corner displays become activated. To obtain instantaneous changes of colors, the temperature sensitive snap spring 128 arrangement of FIG. 14 may be mounted between the bellows end face and the flat shaped surfaces mentioned above.

Figure 19:
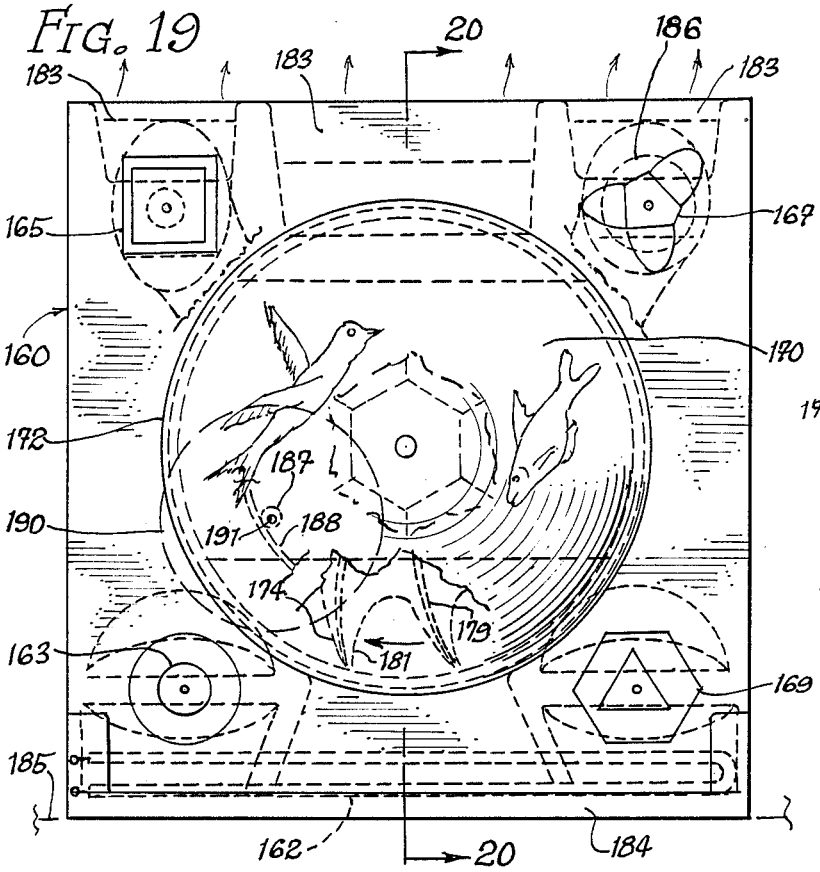
FIG. 19 is an elevation view of an aft object which uses a rotatable member to cause changes in shapes and/or colors of the art object.
Figure 20:
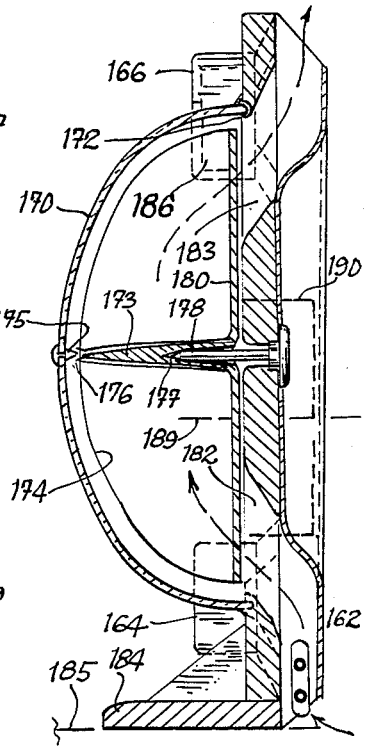
FIG. 20 is a midsectional elevation view of the art object of FIG. 19 taken along section line 20—20 of FIG. 19.
Figure 22:
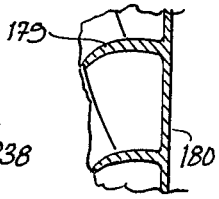
FIG. 22 is a partial sectional view showing details of the rotatable along section line 22—22 of FIG. 21.
Figure 21:
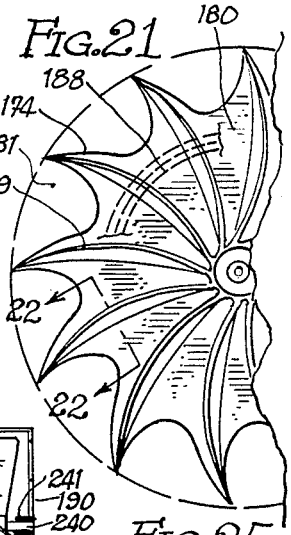
FIG. 21 is a partial elevation view of the rotatable member of the art of FIGS. 19 and 20.

The temperature sensitive film 170 has the general shape of a half ellipsoid of revolution. It is held at its circular edge by frame 160. The film is composed of a plurality of pieces cut and assembled to represent various motives such as the fish and the bird illustrated in FIG. 19.The housing formed by the film contains a wheel 174 free to rotate. Wheel 174 is suspended between two pins 175 and 177 engaging respectively matching conically shaped recesses 176 and 178 in central stem 173 of wheel 174. A plurality of curved vanes such as 179 connect stem 173 to flange 180. Openings such as 181 are cut between vanes 179 in flange 180 to allow warm air to enter the space between the film and the wheel flange, through vent 182, and to leave that space at the top through vent 183. The curvature of vanes 179 causes the ascending warm air to impart a slow rotational movement to wheel 174. This rotational movement affects the heat transfer between the warm air and the film internal surface, at any given point on film 170 by which a vane 179 passes. Changes in the local temperatures of the film result, hence variations of colors and of their patterns. FIGS. 19 and 20 show a three-dimensional art object which can easily and appropriately be made to stand. Frame 160 is fitted with footing 184 which may rest on table or desk top 185 for instance. As mentioned earlier, the rotation of wheel 174 is activated by and dependent on the ascending warm air flow. The rotation speed must be slow enough to provide time for heat to be transferred to or extracted from the film at a rate which causes its local temperatures to vary a few degrees centigrade. The friction torque resisting the wheel motion is minimal (sharp needle point suspension) and the degree of curvature of vanes 179 needs not be large, but high enough to start the wheel turning. Two simple basic construction possibilities are available: (1) set the degree of curvature of the vanes so that the ascending air flow unfailingly initiates the wheel rotation,with the wheel stopping quickly as soon as the air flow stops, and (2) provide an automatic speed control of the wheel so that it never exceeds a maximum value above which the film temperature changes are too small. These two construction can also be combined.

Figure 26:
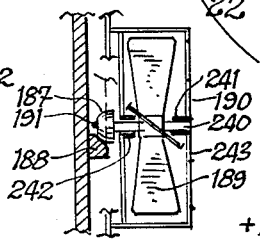
FIG. 26 is a midsectional elevation view of a schematic diagram braking fan construction.

It was earlier mentioned that a shut-off registering system actuated by a bi-stable bimetallic snap spring could be used to interrupt the warm air flow cyclically. Such system is indicated in phantom lines as 186 in FIGS. 19 and 20.Switching the power on and off to heating element 162 will accomplish the same, but the heating element thermal inertia will extraneously lengthen the duration of a cycle beyond an acceptable value. Controlling the wheel speed can easily be performed with the use of an air fan brake, as shown in FIG. 26 and described later in this section. The friction drive for such a fan consists of a pinion 187 engaging circular rack 188 associated with flange 180 of wheel 174. Pinion 187 cooperates with fan 189 (axis shown only) housed in space 190 delineated in phantom lines. The fan blades have an orientation such that the fan axle (free to move toward the rack) pushes quasi-conically shaped pinion 187 against the conical surface of its cooperating rack. Construction provisions are made to insure that pinion and rack are always engaged, as described later. If the wheel rotates too fast, the fan moved the tip 191 of pinion 187 against flange 180 back side. Tip 191 has a small rubber half-ball which provides the braking action needed for adjusting the wheel speed. Normally, under steady operating conditions,the lifting of half of the fan weight by means of the ramp action of the pinion-rack cooperation suffices to control speed.

Figure 23:
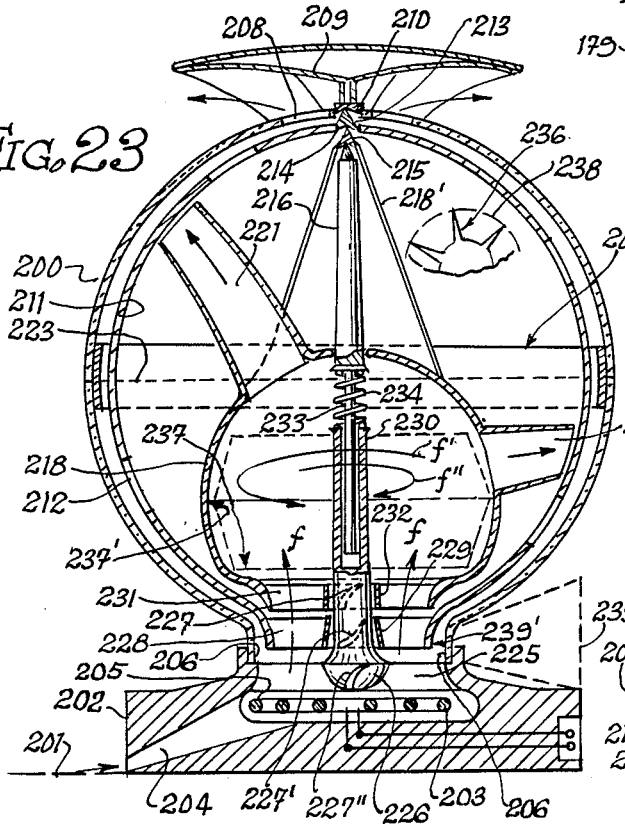
FIG. 23 is a midsectional elevation view of a three-dimensional art ob revolution.
Figure 24:
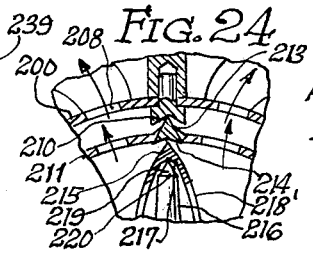
FIG. 24 is a partial sectional view of the suspension system used in the art object of FIG. 23.

FIGS. 23 and 24 present another fully three-dimensional art object in which the temperature sensitive film assembly 200 is given a sperical shape. It is constructed to stand on an horizontal surface,such as the top 201 of a table, a stand or a desk, by means of pedestal 202 in which heating element 203 is flatly coiled. Ambient air is admitted through a plurality of vents 204 distributed around the pedestal into space 205 which is open at its top. Film assembly 200 is supported by the pedestal by circular rim 206. An equatorially located thin structural ring 207 is associated with flat equidistant meridionally located structural members (not shown) to form a lattice structure for giving local support to the film. At its top, film assemblage 200 is provided with a plurality of vent holes 208 to let warm air escape. Above holes 208 and concentrically therewith, an umbrella-shaped protector 209 channels the exhausting warm air sideway and prevents the inadvertent introduction of foreign objects and/or matter inside the art object. The central bottom portion of protector 209 is affixed to the structural lattice earlier mentioned and exhibits a conically shaped recess 210.

A light thin-wall spherically shaped body of revolution 211 is located concentrically with the film surface. A plurality of openings such as 212 are distributed about this body surface. It is equipped with a pointed member 213 engaging recess 210, the underside of member 213 also exhibits a conically shaped recess 214 for receiving point 215 of supporting conical recess 217 in which point 219 of central supporting mast 216 fits (FIG. 24). Another internally and quasi-concentrically located body 218 is suspended by means of conical structure 218' to mast 216 with the cooperation of recess 217. All points and recess bottoms are aligned and located on the axis of symmetry of the quasi sphere formed by the film.The middle part of body 218 is bulbous and receives most of the warm air. This air is channelled out by a plurality of ducts such as 221 and 222 to body 211 spherical wall. Openings 212 and the corresponding open ends of the ducts are situated at equal vertical distances of the equatorial line 223 so that they may register as bodies 211 and 218 rotate with respect to one another. The numbers of openings and ducts are prime and different, e.g. five openings and three ducts, at a given latitude. These bodies may be caused to rotate in the same direction or in opposite directions, as is the case in FIG. 23.

Pedestal 202 is connected to the bottom part 225 of structural column 230 by a plurality of radially oriented vanes 226 having a profile 227.Vanes 227 are shaped to curve the flow path of warm air so that it exerts a torque on blades 228 connecting the rim of body 211 to a centering ring 229 positioned around column 230 but not in contact therewith.The warm air flow is turned back upwardly and impacts blades 231 connecting body 218 lower rim to a centering ring 232 also positioned around column 230 but making no contact therewith either. The profiles of blades 228 and 231, labeled respectively 227"and 227" are shown in phantom lines. One set of blades act as the blades of an action turbine and the other set as the blades of a reaction turbine (bodies 211 and 218 counter-rotating as indicated by arrows f' and f'', when air flows per arrows f). Annular spaces are provided between the concentric rims of film assembly 200, of body 211 and of body 218, so as to eliminate friction and to allow some warm air to flow directly into the volumes located between these structures.Rings 229 and 232 generate no friction either during their rotations, if the art object axis is vertical.The only existing friction is that which is caused by the contact points of the suspension system of bodies 211 and 218, and which is negligible.

The art object can be assembled or disassembled at the equatorial line 223 level, ring 207 being solidly attached to one of the film assemblage hemispheres and the other being easily removable.Central structure column 230 is hollow in its upper half so as to receive sliding stem 233 which is connected to mast 216. The top of column 230 and the bottom of mast 216 are both fitted with a small flange. Compression spring 234 is located between these two flanges and balances the added weights of the rotating bodies and of mast 216. In addition to balancing these weights, spring 234 also exerts very small forces at the contact points of the articulations described earlier, in order to maintain the rotating bodies vertical and in perfect alignment.The stacked up assembly is stable because each component center of gravity is located well below its suspension point. Though not shown in Figure 23,body 218 also is provided with an joint plane so that it may be easily assembled and disassembled.A typical motive of the film is illustrated in the form of a portion of a sun FIG. 236 with rays, in solid lines, although not visible, centered in a circle 238 shown in phantom lines and which represents the contour of the end of a duct 221 aligned with the motive. For reasons earlier discussed, the revolving speeds of both bodies must be kept low enough to permit film 200 to change its temperatures locally. For a known ascending velocity of the air, the curvatures of blades 226, 228 and 232 determine the angular speeds of the turbines. To obtain a torque high enough to start unfailingly the rotation of both bodies, these curvatures must be larger than required to sustain steady state conditions. Here again it is almost mandatory to control the rotational speeds of both bodies. This can be done by controlling the speeds of body 218 with respect to still column 230 and of body 211 with respect to pedestal 202. To that effect, space 237 inside body 218 and space 239 outside of film assemblage 200 and above pedestal 202 may be utilized. The racks actuating pinions such as 187 (Figure 26) can be mounted on body 218 at point 237' and at point 239' on the bottom rim of body 211.

For use with the art object of FIG. 23, the speed control and braking fan arrangement shown in FIG. 26 needs only be modified slightly, shapewise, so that its external configuration fits the envelopes defined by contour 239 and the left (or right) side of contour 237. The principle of operation is the same as earlier described for the art object of FIGS. 19-21. Some additional description of the fan is required. Fan axle 240 can only rotate in its supporting journal 241. Journal 242 is elongated vertically and only guides axle 240 laterally when the fan is in place. The ramp of rack 188 actually supports the other end of axle 240 by allowing pinion 187 to rest on it at all times. Rack 188 then always supports half of the weight of the fan assembly. The travel of axle 240 is limited by wall 243 against which the axle end butts.Pinion 187 thus never loses contact with rack 188 ramp, remains always engaged and is continuously ready to apply its braking friction action in addition to its aerodynamic brake. In the case of the art object of FIG. 23, the friction braking action by means of rubber halfball 191, first causes a small tilting of the vertical axis of the surface on which halfball 191 pushes, be it body 218 or body 211. Such action causes rings 229 and 232 to contact column 230 and produce a drag force which is enough to reduce the body rotational speeds immediately. The fan and pinion-rack assembly sizes can be tailored to insure control speeds of the bodies that are slow enough to yield the temperature variations required by the assemblage of dynamic art film.

Figure 25:
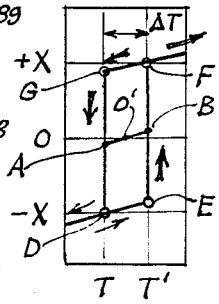
FIG. 25 is a diagram illustrating the type of temperature hysteresis diagram that describes the operation of the expansion member depicted in FIG. 14.

The displacement diagram of FIG. 25 indicates how the displacement of the free end of a bimetallic bi-stable disk varies as a function of temperature. Assuming that the disk is subjected to a temperature change larger than $\Delta T$ (from a temperature lower than T to a temperature higher than T'), the disk will change its shape from a concave to a convex curvature in a snappy motion. If X and ' represent the axial displacements of the disk center relatively to its edge (flat disk shape), the total displacement of the center with respect to the edge is 2X. If the stable shape of the disk were flat, the temperature variation $\Delta T$ would simply cause a disk deformation corresponding to line segment A-B and to a small relative displacement of little value. However, the rest stress-free shape of the disk is not flat, but curved by deforming permanently the disk so that its springy material is prestressed at rest to build in the disk tension and compression stresses which balance the internal forces that they each generate. Thus, the disk can never, if free to deform, assume a shape which enables it to deform along A-B. Point 0' can never be reached, except when the disk snaps from one shape (convex or concave) to another (concave or convex).

Assuming that no external forces are imposed on the disk and it is at a temperature lower than T, and a slow heating rate of the disk, the edge/center displacements of the disk follow the arrows shown in FIG. 25.At point D, thermal stresses start building up within the disk because of the differential expansion between the two faces of the disk (bimetallic construction). These thermal stresses cause a very small displacement (D to E) to take place in the X direction, opposing the pre-stressing forces already built-in. However, at point E, if the disk is given a small nudge is the X direction,it will snap to a new shape for which the equilibrium of thermal stresses and built-in stresses is more stable, the snapping action producing displacement 2X, and passing through point B the edge/center displacement reaches point F, while the disk remains at temperature T'. If, at that point, the disk starts cooling down, from point F on, the displacement-temperature curve follows the left arrow while the disk retains its new shape, to point G. At point G, the reverse snapping process takes place if the disk is given some enticement to return to its starting shape. The disk shape then returns to its original form (point D). The displacement-temperature curve thus has the shape of a typical hysteresis curve around point 0'. It was mentioned that at points E and G, a nudge (or enticement) must be given to the disk for snapping into shape. This nudging action, required in both directions,is needed to provide the externally applied forces which must make up for the differences between the built-in stresses and the thermal stresses as available within the disk at points E or G,if $\Delta T$ is to be small and $2\times$ large enough. Referring to FIG. 14, this bi-directional nudging action is provided by wall 108'in one direction and by stop 249 in the other direction.In other words, a full expansion and retraction cycle of temperature-sensitive bellows 120 is needed to insure a proper operation of snappy springy disk 128. The temperature variation range $\Delta T'$ to which the bellows must be exposed must then exceed $\Delta T$ by an appreciable amount.

FIGS. 27 to 35 present versions of dynamic art film displays which enable the viewer to interact with the display, whether or not the color patterns are also induced to change by means independent from the viewer and originally built-in by the artist. A typical display is illustrated in FIGS. 27–33, and which consists of two parts: (1) the artist's creation, and (2) the means made available to the viewer for varying the art work appearance as the viewer so wishes. The art object includes viewing film or screen 250 held by rigid frame 251 supported by rigid back structure 252 shaped to leave a shallow space 253 behind film 250 in a manner such that a small push against the film in arrow f direction causes the film to contact the back structure with a very small concomitant deformation of the film. Such push can be safely effected with the help of a paddle manipulated by the viewer and shown by phantom line contour 254.Film 250 may be either temperature or pressure sensitive (or a combination of both). As typical embodiments of this version of the invention, for the purpose of this description, the uses of temperature sensitive and pressure sensitive films in these embodiments are described separately.

The frame and the back structure provide air vents such as 255 in the bottom part, connecting inlet slot 256 into space 253 with the outside. Air vents such as 257 located in the top part of the frame assembly allow air in space 253 to leave by means of outlet slot 258.Air deflector 259 prevents dust from settling in vents 257 and inside space 253. The screen consists of an assemblage of various juxtaposed shaped sections of temperature sensitive film such as those depicted by motives 260, 261, 262 and 263, which represent specific designs and which themselves may comprise smaller size sections. A slot opening is located on the side of the frame as indicated by gap 265 which extends the full area behind the screen, thus enabling the insertion of an embossed plate between the screen and back structure 252 in space 253. Elements such as 266, 267, 268 and 269 are mounted onto the back structure.Their front surfaces match the curved contour of space 253 so as to offer a continuity of the support surface when screen 250 is pushed against the back structure. Some of these elements are heated and some may act as a heat sink, in order to affect the local temperature of some of the screen sections when they come into contact with these elements.

In the case of the simplest configuration of pressure sensitive film, designs built in the film such as 260-263 need not be used. The relief design motives on the embossed plate provide the localized pressure differences or gradients from point to point on the screen needed for causing the shear forces and the concomitant differential orientations of the liquid crystals. These generate the resulting color patterns which then follow the design contours in relief on the embossed plate. As earlier mentioned, the matrix in which the liquid crystals are dispersed is viscous and some time elapses between the removal of the manipulated paddle off the screen by the viewer and the return of the matrix-crystal mixture to its original location. During the transitory time taken by the mixture to reassume its undisturbed state, the mixture motion causes continuous, slowly changing varieties of colors, patterns, designs and combinations thereof, unlikely to ever repeat in an identical fashion. The paddle may also incorporate an embossed plate of its own and which may be used singularly or in conjunction with an embossed plate in the dynamic art display.

A typical paddle configuration representing a heart, corresponding to contour 254, is shown in FIGS. 32 and 33. It comprises a body 270 connected by a stem 271 to a handle 272 attached to the wall by extensible cord 273. If the paddle houses a heating element inside body 270, cord 273 is an electrical cord connected to electrical outlet 274. The paddle body is hollow and shaped for housing an embossed plate and/or a heating element in cavity 275. Such cavity is confined under structural top 276 by skirt 277 and by soft flexible bottom pad 278. Cavity 275 may include the interchangeable member 279 which may be a heating element or an embossed plate, or both combined.

If both a heating element and an embossed plate are used concurrently, the heating element is located against structure 276 and the embossed plate relief faces down toward flexible bottom pad 278. This structural somewhat flexible bottom pad is shaped to exhibit a curved external form which matches the general curvature of the back surface of space 253 so as to provide a good fit between the paddle pad and the deformed screen. The pad is covered with a soft non-abrasive membrane which facilitates the sliding of the paddle on the screen external surface, but which hinders neither heat transfer nor relief design impressions on the film appreciably. The details of the attachment and securing of the heating element and/or the embossed plate are not shown, being well known and understood in the art, but those are provided by small fingers (not shown) projecting inwardly from skirt 270. When the paddle is applied properly onto the screen,the rim of the paddle skirt cannot touch the screen external surface.

FIGS. 30 and 31 show the outline and the sectional profile of a typical embossed plate. It is configured in dimension and contour to fit gap cavity 265 of frame 251 for instance, being introduced in the direction of arrows f' into gap 265 side slot. The width w of the gap must be larger than the maximum thickness t (FIG. 31) that the thickest relief will give to any of the embossed plates to be used. Embossed plate 280 has a flat base 281 extending the whole contour of the plate. This flat rigid structure fits snugly into corresponding grooves located around the periphery of gap 265 cavity. When embossed plate 280 is engaged into gap 265, it is thus prevented from moving in any direction, except in and out along arrows f'.

Referring now to FIGS. 34 and 35, another heating element configuration for the art display of FIG. 27 is presented. It is similar to that previously described for FIGS. 15 and 16, but somewhat arranged differently and better adapted to the embodiment now being discussed. A revolving drum 285 supported by trunnion 286, affixed to end structure 286', and drive shaft 287 emerging from speed reducing gear box 288 is driven by electric motor 289. Electrical cord 290 supplies power. Drum 285 fits in cylinder 291 and has openings such as 292 and 293 that register cyclically with corresponding openings 294 and 295 in cylinder 291 walls. Registering thus provides the opening and closing action of air vents such as 255 in frame 251 as motor 289 rotates. Body 296 houses the drum, the motor and heating element 297. It is attached to the bottom of frame 251. Above the chamber housing heating element 297 is another small cavity 298 in which a gate 299 can slide when pulled in and/or out by handle 300. Gate 300 has openings such as 301 distributed along its length for either registering or closing openings such as 302 located between the heating element chamber and cavity 298. This manually operated registering of the vents opening into space 253 overrides the cyclical automatic registering action provided by the electric motor and associated drum 285.

FIG. 36 shows a detail of a typical joint between two adjacent sections of the temperature sensitive film. A very narrow gap 305 is always present between the contiguous edges of two adjacent portions of film sections. The left section consists of two plastic layers 306 and 308 sandwiching layer 307 in which liquid crystals are embedded. The other section is identical and its callout numbers are the same, but have a ' index. The other dissimilarity, impossible to represent graphically, is that the liquid crystals in the two sections have different phase-change temperatures. The two sections are joined by membranes 310 and 312. Assuming that the film is viewed from the top in FIG. 36, membrane 312 is transparent, whereas membrane 310 may be opaque depending upon whether plastic layers 306 and 306' are opaque.

FIGS. 37 to 39 illustrate a mode of construction of pressure sensitive film which is most applicable to the dynamic art display embodiment of FIG. 27. Bottom membrane 320 is laid on a flat rigid surface 321 and is coated on its top surface with a pressure adhesive.Small thin-walled flexible balls such as 322 are dispersed onto the adhesive coating and stick thereto. A second membrane layer 323 also being adhesive-coated on its underface is brought down to contact the balls under some pressure. Sticky contacts are then also established between the second membrane and the balls, leaving an empty space 324 between the membranes and the balls. The balls are deformable and may contain either a gas or a liquid. The membranes have the final dimensions, size and shape which are desired of them and appear as shown in FIG. 38 where a rectangular-shaped film assembly is depicted. The balls are dispersed only within the boundary 329 of the bottom membrane, leaving a band 331 coated with adhesive, but free of balls.Two flexible tubes 332 and 333 are inserted between the two membranes. FIG. 39 indicates how the space between the two membranes and the balls is then sealed.

The mattress formed by the assembly 330 of balls holding two oppositely adhesive coated and positioned membranes is secured between two constraining rigid flat structures while pressure-applying members 334 and 336 are brought together to cause the adhesive coatings on the two membranes to form seal 335. The extremities of flexible tubes 332 and 333 are engaged between the two membranes, the ends of these tubes are flexible enough to flatten out, but resilent enough to snap back to shape and open sufficiently to permit the insertion of another smaller rigid tube for future handling. Internal space 324 is thus sealed off except for the two open tubes. At this juncture, the adhesives on the internal surfaces of the membranes, now facing one another for ever, can be handled in two ways: (1) ignored because the membranes will never come into contact anyway, or (2) eliminated by means of a curing process or a fluid introduced through tubes 332 and 333, and thereby inactivated. In any event, a thin empty mattres-like film is now available. A mixture of liquid crystals dispersed in an appopriate matrix fluid is then introduced in space 324 by means of the two openings provided by the tube extremities previously mentioned. Upon completion of the filling operation, the two openings are also closed and sealed. The pressure sensitive film assembly is now ready for installation on frame 251, in a manner such that bands 329 become locked between the frame structure and a securing structural member.

The film construction method described above ideally applies to film configurations which are devoid of design outlines built in the film and that are intended to prevent the matrix mixture from flowing between sections segregated by such design outlines. In the latter case, small sections of film assemblies may be constructed so as to have the shape of typical sections of a puzzle where the puzzle section lines correspond to the design outline contour lines. Such separate sections can then be assembled as illustrated in FIG. 36. This section-assembling approach seems particularly attractive in the embodiments of the present invention in which concurrent use is made of both temperature and pressure sensitive films. Design outlines can also be created with the film of FIGS. 38 and 39 if the membrane adhesive coatings are left undisturbed and the adhesive materials can still adhere to one another even after space 324 has been filled with matrix crystal mixture, which only requires proper material selection and compatibility of the adhesives, liquid crystals and matrix.

DISCUSSION AND OPERATION

The descriptions of dynamic art displays presented in the previous section all pertained to two basic types of responses that characterize liquid crystals: their phase change and crystal orientation influences on incident white light scattering, which results in the production of elementary colors of the visible spectrum. Phase changes are induced by temperature changes of constrained crystals and orientation changes result from orientation variations of movable crystals within a complying matrix. Orientation changes are caused by pressure gradients in the matrix resulting in localized laminar flows of the mixture of matrix and liquid crystals between two constraining walls. In order to establish a common trait between various embodiments of these two basic types of responses, heat is used as the medium for causing both temperature changes and pressure gradients, heat being easy to generate and producing temperature variations and/or motion by means of very simple mechanisms.

But heat is not the only medium that can be used. For the record, although impractical for use in embodiments of the present invention, radiations such as X-rays also affect the birefringence characteristics of some liquid crystals. More practical and widely used in commercial applications is the response of liquid crystals to electrostatic fields. For dynamic art displays such as those previously described, the use of continuously varying electrostatic fields, spatially and temporally, is neither simple nor as staightforward as that of heat. The capsules in which the liquid crystals are contained can be given magnetic properties by incorporating iron compounds with the liquid crystals in the capsules. The application of magnetic fields of variable intensity near such capsules will influence their orientation within the matrix liquid in which the capsules are dispersed and produce the results which pressure gradients do. This, however, requires the utilization of liquid crystals in forms not so easily available commercially.

To establish a basis for dynamic art which is both technically easily feasible and commercially available, the approaches of principle described in FIGS. 1 to 4 seem the easiest to understand and to embody.The selection of these two approaches however should not be construed as being limitative and excluding the use of media of a different nature as means for varying the birefringence properties of liquid crystals for use in dynamic art displays. For instance, the arrangement configuration of FIGS. 1 and 2 (or FIGS. 3 and 4) can easily be modified and adapted to represent basic embodiments of approaches using either electrostatic or magnetic (or combinations thereof) media for affecting the liquid crystals in films 30 or 40. Depending on the nature of the liquid crystals present in the films, an electrostatic field can be generated between flange 32 and the left side of film 30, or shaft 46 end can be made the pole of a permanent magnet. Temperature and/or pressure variations are no longer needed, although their combined uses with electric and/or magnetic fields should not be excluded either. However, the adaptation of the principle approaches presented in FIGS. 1 to 4 to electric and magnetic fields discussed hereunder briefly ignore such combination possibilities for the sake of simplicity.

The electrostatic field can be created by covering the left side of film 30 with a thin transparent conducting layer and connecting duct 31 wall (made of conducting material) and said conducting as to generates an electric potential differential across film 30.The conducting layer may consist of a grid of very fine wires covering the full area of the film. A very thin metallic coating (gold or aluminum for example) can also be used, such thin layer being transparent to light. An external plastic coating may be used to cover the wire grid or the metallic coating, for mechanical protection and electrical insulation. The intensity of the electrostatic field can be varied by changing the voltage across film 30 and/or the distance between film 30 and flange 32. Again in this instance, the possibility exists to alter the response of the liquid crystals, if free to orient themselves according to the field strength, so that ever changing patterns of colors can be generated.

If the capsules in which the liquid crystals are constrained also contain an iron compound, thereby rendering them responsive to magnetic field variations, shaft 46 of FIG. 3 can represent a permanent magnet having a given polarity. Its neighbor, shaft 46' of FIG. 4 can be a permanent magnet also, but of opposite polarity, thereby creating a magnetic field across film 40 causing the capsules to orient themselves along the force lines joining the two opposite poles of said magnets.The variety of orientations of adjacent liquid crystals thus results again in a multitude of color patterns which vary in forms, colors and intensities Here again, the distance between the magnets, their relative orientations, their distance from film 40 and shapes can be made to vary spatially and temporally. Various film sections in the film can be arranged to create designs, if the concentration of iron compounds in the capsules is adjusted differently in contiguously positioned film sections, thereby altering the degree of response to a given magnetic field strength of each section.

Both duct-flange assemblies of FIGS. 1–2 and shaft-magnets of FIGS. 3 and 4 can be mounted on the positioning arms of mechanisms actuated in ways similar to those depicted in FIGS. 5 to 26 for instance. Rotating mechanisms actuated by slowly revolving low power electric motors, such as those used in electric clocks or for timers may be utilized instead of heat responsive actuators.In embodiments of the present invention utilizing electrostatic fields as activating medium, the spatial and temporal variations of field strength can be adjusted and controlled electronically so as to avoid any type of moving mechanical parts. A second set of electric poles facing conducting film 30 can be obtained in such instance by using elements such as 266–269 of Figures 27-28 onto which various and varying voltages are applied. If interaction by the viewer is desired, the paddle of Figures 32-33 can incorporate the other layer of conducting material. In such a case, the viewer creates the electrostatic field and causes its strength to change. The above-mentioned embodiments are briefly described and discussed only to indicate the magnitude of the numbers of possiblities available for creating displays of dynamic art,using technical approaches other than those which are further discussed below.

The two types of film, temperature and pressure sensitive, are extensively discussed in the previous sections. They are commercially available with a wide range of characteristics and in a variety of forms. No further discussion of the temperature sensitive film is needed. However, the pressure sensitive films are of a different nature altogether and need futher elaboration. In those, the liquid crystals must be able to move. Also, this mobility is necessary in the case of films used in conjunction with the use of electrostatic and/or magnetic fields as influencing media. In all those instances, the slurry of matrix liquid and therein dispersed capsules,however viscous, must be able to flow between the two constraining plastic layers. If such layers were always positioned horizontally on a flat surface, gravity would not influence the slurry flow between layers which would remain at a constant distance (steady state). However, when such a film is positioned vertically, the gravity forces always slowly overcome the resisting viscous forces caused by any flow and the downward creeping motion of the mixture only stops when the bulging out of the layers at the bottom of one section causes hoop stresses in the layers large enough to balance the hydrostatic pressure in the mixture, in which case another steady state condition results. But the thickness of the mixture varies throughout the film section and the color pattern throughout the section is not uniform. Although such a behavior of the slurry could be used as a way to generate changes in color patterns, by every so often setting the film upside down, this process is too slow to be of practical interest here, but disturbing enough to require a practical solution. The first and simplest solution is to limit the height of all sections of the display screen to a dimension such that the degree of steady-state bulging of any section does not cause noticeable color variations throughout that section. The second solution is to create dynamic art display designs of a nature such that color variations caused by gravity are relatively unimportant. This is the case when the changes of color patterns and designs are fast enough and when the dynamics of such change is the major most important feature of the display. The third solution is to design displays in which such creeping changes are exploited to add another means for causing unpredictable variations of the display background colors. The fourth and last solution is that which is presented in FIGS. 37-39.

Although the construction of such a "creep-free" film has already been well described, futher elaboration is nevertheless justified. Referring to FIG. 37, when pressure is applied onto the upper membrane, the thickness F of the film decreases an amount ΔF. The ball diameter δ increases to a flattened shape of diameter Δ. Concurrently, the previous point contact between the balls and the membranes enlarges to a circle of diameter C. Adhesive coatings are utilized in the construction of the film and create the necessary point contacts. As earlier mentioned, the adhesive material present on almost the totality of the membrane inner surfaces can be neutralized or deactivated in a number of ways. A list of possible construction approaches is presented below, as examples of the many available possibilities:

1. Adhesive remains as is, matrix material having wetted the adhesive once prevents the remnant of the ball walls from adhering;
2. An adhesive-removing solvent is used to dissolve the adhesive which has not reacted with the coating on the balls during the curing operation of the ball-membrane contacts;
3. The curing operation of the ball-membrane contacts causes the exposed adhesive to lose its adhesivity quality;
4. With the matrix fluid in place, the adhesive ability to stick is greatly reduced and maintains contact for a short while only;
5. The balls and the membranes are coated after assembly with a liquid which leaves non-sticking surfaces upon removal;
6. A substance is added to the matrix and which, after a while, reacts with the exposed adhesive to render it non-sticky; etc..

This list is long enough to show that the adhesive can either be neutralized or transformed to render it useful in providing side effects which can be utilized advantageously: i.e. making the adhesive sticks for a short while in order to create a time delay between the time the pressure is removed and the time the membranes return to their original relative positions, thereby slowing down the disappearance of color patterns.

The balls themselves may contain liquid crystals which are temperature sensitive, an inert liquid or a gas. The wall material of the balls may be extensible or almost non-stretchable. Again, the design combinations are numerous and varied, all available to the designer for creating various kinds of dynamic art films. Other design parameters of the film are important because of their influence on the film mechanical response to pressure. As an example, such parameters are: the ratio of ball volume to matrix volume,the diameter δ of the balls, whether the balls contain a gas or a liquid, the dispersion pattern of the balls, the ratio of ball diameter δ to capsule length, etc... In any event, the matrix-capsule mixture must be considered incompressible and the volume lost by a local compression ΔF of the membrane mattress must be made up by an increase of F somewhere else. This increase of F may materialize virtually by means of a local bulging of the membranes between balls, an elongation of the balls (it is assumed that the ball-membrane contacts transmit tension) between their two contact points, a reduction of the ball volumes if the balls contain a gas, etc. . . . But the ball-membrane contacts must strong enough and never break.

Such a condition can be met by following fabrication steps that insure a good size strong bond at the ball-membrane contact point.The external surface of the ball walls are coated with one part of a two-part adhesive, the second part of the adhesive is used to coat the membrane surface and is tacky. When exposed to the curing temperature, the ball coating softens and reacts with the second part of the adhesive with which it is in contact. At the same time, the pressure inside the mattress is lowered below atmospheric so as to deform the membranes inwardly in order to increase the contact area between balls and membranes. This also insures that all balls will make contact with both membranes symmetrically.At the end of the curing step,the pressure inside the assembly is equalized with atmospheric.The film mattress is then ready for filling with the matrix/liquid-crystal mixture, all balls being strongly bonded to the membranes by means of a sizable contact area. The resulting slightly dimpled appearance of the membrane external surfaces is then of no consequence. In the embodiments described in the previous section, heat is used to warm ambient air which then becomes the working fluid to cause either temperature or pressure changes,or both. The motion creating mechanisms utilize differential expansion to provide actuating forces. Such arrangements can easily be configured to generate either random or programmed coordinated movements and fit equally well applications using both types of film. Simple inexpensive sources of low level power are commercially available in the form of slow electric motors and their asociated gear reduction means. Their speed is a function of the frequency of the alternating current powering them. It is simple and easy electronically to cause such frequency to vary within a wide range. The variable speed rotation of an electric clock motor so modified can be used to cause mechanisms located between the screen and the frame back structure to move. Such movements may thus be characterized by variable speeds, said speed variations happening either at random or according to a program. In the case of pressure sensitive film applications, a heat source is not neede-d.In the case of temperature sensitive film applications, a heat source is still required to produce the temperature changes in the screen. However, the configurations of the paths followed by the warm air flows can be altered by a system of gates actuated by an electric motor . These alternate paths can be arranged to form a type of maze behind the screen of ever changing configuration.

Permanent magnets and/or electrically charged panels of various shapes can be made to rotate, move sideways, vary the distances separating them from the screen, etc... by means of such modified-electric-motor actuated mechanisms.The internal surface of the frame back panel may not be flat but configured to form slightly elevated relief patterns which vary the separating distance between the frame back structure and the screen according to location. A fixed length member,-such as a rolling wheel, made to move sideways between such surface and the screen will cause variable pressure points of everchanging locations to move about the screen. A plurality of such wheels can be caused to move about either synchronously or at random, thus forming changing color patterns and/or designs.In the cases of field-strength (electric or magnetic) sensitive films, separating distances are made to vary, not pressures. In the latter case, a thin inextensible membrane is stretched behind the viewing screen,supported by the frame between the wheels and the screen, not touching the screen but applying a light pressure on the wheels toward the back panel. The permanent magnets and/or electrically-charged flat poles are then mounted on such intermediary deformable membrane.

In dynamic art displays which enable viewer's interaction, the mode of interaction could be more direct than that which a paddle provides. The use of fingers (pressure and temperature) or breath (temperature) is possible but not recommended in the case of art objects exposed in public, for obvious reasons. Such applications are more viable for objects used as toys or for personal enjoyment, although such objects can hardly be categorized as art displays. However, they are of commercial interest either as playthings or as teaching tools for instance. They are mentioned here in passing but not worthy of further discussion. The artist contribution to their design is unimportant. The use of an intermediary structural member by the viewer is then a must. The shape of the paddle, the designs it may superimpose on those already built in the screen and the combinations derived therefrom are part of the artist's creation. The manner, the location, the speed in which it is applied constitute the realm of the viewer.The modes of operation and types of construction of art displays are necessarily quite different depending upon whether viewer's interaction is intended. This becomes very apparent when one compares the embodiments of FIGS. 10, 11, 12, 19, 20 and 23 to those of FIGS. 27, 28 and 29.

In the first instance, the artist's concern and contribution are to marry and combine the engineering aspect of the construction (that which is located behind the screen) with the artistic composition of the display (that which constitutes the screen). In the second instance, the engineering aspect of the construction of the art display is simple, the composition of the screen is much more challenging because it involves combining possibilities brought in by the paddle interaction, which may incorporate also its own design composition. In the first instance, once the art display is built, very little can be done to change the course of its behavior: future color "happenings", although unpredictable, are fixed. In the second instance, the built-in flexibility of forms and designs (embossed plates, paddle interaction) is a source of ever changing new artistic possibilities. The contribution of the artist is to create a screen composition which widens the range of such possibilities, and the multiplicity thereof, by his/her choice of motives for the designs and which are intended to be made to appear on the screen by the viewer. The few sample embodiments of the present invention described and discussed in the foregoing will serve to illustrate the many usage modes which this new type of artistic creation offers. It has its place in museums, homes, offices and schools alike. Dynamic art can be viewed for enjoyment, played with or used as a teaching tool for art appreciation, design composition, etc. . . Therefore, it is thought that the dynamic art apparatus and method for constructing such apparatus for dynamic art display of the present invention and many of its attendant advantages will be understood from the foregoing and that it will be apparent that various changes may be made in form, construction and arrangement of the parts thereof without departing from the spirit and scope of the invention or sacrificing all or any of its material advantages, the forms hereinbefore described being merely preferred or examplary embodiments thereof.

Having thus described my invention, I now claim:

1. An apparatus for displaying dynamic art, comprising:

a plurality of generally planar puzzle pieces each including a layer of a liquid crystal material which changes in externally perceived color when subjected to variations in temperature;

frame means for supporting the puzzle pieces in a predetermined pattern with their side edges adjacent one another and with air gaps therebetween; and means for subjecting the puzzle pieces to a continuously varying flow pattern of heated air for causing the puzzle pieces to continuously vary in color.

2. An apparatus according to claim 1 and further comprising heated paddle means manually engageable with at least one of the puzzle pieces to vary the color thereof.

3. An apparatus for displaying dynamic art, comprising:

a plurality of generally planar film elements, each including a transparent layer and an opaque layer, one of said layers being flexible and the other being substantially rigid, and a quantity of encapsulated liquid crystal material embedded in a holding matrix, the externally perceived color of said material varying when pressure is applied to deform the flexible layer;

frame means for supporting the film elements in a predetermined pattern with their side edges adjacent one another;

a plurality of heat sensors which deform when subjected to temperature variations and which are positioned to engage and deform the flexible layers of corresponding ones of the film elements; and means for subjecting the heat sensors to a continuously varying flow pattern of heated air for causing the film elements to continuously vary in color.

4. An apparatus according to claim 3 and further comprising embossed paddle means manually engageable with at least one of the film elements to vary the color thereof.

5. An apparatus for displaying dynamic art comprising:

a plurality of generally planar puzzle pieces each including a layer of a liquid crystal material which changes in externally perceived color when subjected to variations in temperature;

a plurality of generally planar film elements, each including a transparent layer and an opaque layer, one of said layers being flexible and the other being substantially rigid, and a quantity of encapsulated liquid crystal material embedded in a holding matrix, the externally perceived color of said material varying when pressure is applied to deform the flexible layer;

frame means for supporting the puzzle pieces and film elements in a predetermined pattern so that their colors can be simultaneously perceived by a viewer;

a plurality of heat sensors which deform when subjected to temperature variations and which are positioned to engage and deform the flexible layers of corresponding ones of the film elements; and means for subjecting the heat sensors and the puzzle pieces to a continuously varying flow pattern of heated air for causing the film pieces and puzzle pieces to continuously vary in color.

6. An apparatus according to claim 5 and further comprising means for rotating at least a portion of the frame means.

7. An apparatus for displaying dynamic art comprising:

a pair of hollow spheres, an inner one of the spheres being small enough to fit inside an outer one of the spheres, the outer sphere being made of a liquid crystal film material that changes in color when subjected to variations in temperature and the inner sphere having a plurality of openings therein;

pedestal means for supporting the spheres for concentric relative rotation;

means for introducing a continuously varying flow of warm air inside the inner sphere to vary the colors exhibited by different portions of the outer sphere; and turbine means activated by the flow of warm air for causing relative rotation between the inner and outer spheres.

8. An apparatus for displaying dynamic art, comprising:

a plurality of generally planar film elements, each including a transparent layer and an opaque layer, and a quantity of encapsulated liquid crystal material embedded in a holding matrix including an iron compound, the externally perceived color of said material varying when a magnetic filed is applied thereto;

frame means for supporting the film elements in a predetermined pattern with their side edges adjacent one another; and means for subjecting the film elements to a magnetic filed to vary the color thereof.

* * * * *